US006425421B1

(12) United States Patent
Morrison

(10) Patent No.: US 6,425,421 B1
(45) Date of Patent: Jul. 30, 2002

(54) METHOD AND APPARATUS FOR DECANTING WINE

(76) Inventor: Robert E. Morrison, 1103 Wilkes St., Alexandria, VA (US) 22314

( * ) Notice: Subject to any disclaimer, the term of this patent is extended or adjusted under 35 U.S.C. 154(b) by 0 days.

(21) Appl. No.: 09/783,865

(22) Filed: Feb. 15, 2001

(51) Int. Cl.[7] ..... B65B 31/00
(52) U.S. Cl. ..... 141/64; 222/400.8
(58) Field of Search ..... 141/64; 222/400.8, 222/209, 180, 185.1, 464.2

(56) References Cited

U.S. PATENT DOCUMENTS

| | | | | |
|---|---|---|---|---|
| 1,249,341 | A | * | 12/1917 | Cropsey |
| 1,372,968 | A | * | 3/1921 | Lowy |
| 2,154,393 | A | * | 4/1939 | Bates |
| 2,347,123 | A | * | 4/1944 | Riesgo |
| 2,805,798 | A | * | 9/1957 | Sampson |
| 2,854,175 | A | * | 9/1958 | Sptizmesser |
| 4,327,782 | A | * | 5/1982 | McKibben et al. |
| 4,436,227 | A | | 3/1984 | Johnson, Jr. et al. ..... 222/382 |
| 4,515,334 | A | * | 5/1985 | Horne |
| 4,595,121 | A | * | 6/1986 | Schultz |
| 4,667,856 | A | | 5/1987 | Nelson ..... 222/180 |
| 4,836,476 | A | * | 6/1989 | Wolf |
| 4,944,477 | A | * | 7/1990 | Hendren |
| 5,114,033 | A | | 5/1992 | Golias et al. ..... 222/82 |
| 5,376,272 | A | | 12/1994 | Spearman ..... 210/463 |
| 5,624,043 | A | * | 4/1997 | Baptista |
| 5,740,949 | A | | 4/1998 | Park ..... 222/209 |
| 5,743,442 | A | * | 4/1998 | Barbe |

FOREIGN PATENT DOCUMENTS

| | | | |
|---|---|---|---|
| DE | 3145694 | A1 * | 5/1983 |
| EP | 0234645 | A1 * | 9/1987 |

* cited by examiner

*Primary Examiner*—David J. Walczak
*Assistant Examiner*—Khoa D. Huynh
(74) *Attorney, Agent, or Firm*—Henderson & Sturm LLP

(57) ABSTRACT

A method and apparatus (10) for transferring wine from a wine bottle (100) to a decanting receptacle (200) wherein the apparatus (10) includes: a pump unit (11) for introducing pressurized air into the interior of the wine bottle; a fluid withdrawal unit (12) for allowing the wine to flow out of the wine bottle (100) into a decanting receptacle (200); and, a support unit (13) for supporting the bottom of the wine bottle (100) at an angular inclination "α" to consolidate the lees (110) on one side of the bottle (100); wherein, a fluid withdrawal head member (50) is provided with a plurality of lateral passageways (55) disposed at a height of "h" above the bottom of the head member (50) to prevent the lees (110) from being transferred into the decanting receptacle.

4 Claims, 2 Drawing Sheets

METHOD AND APPARATUS FOR DECANTING WINE

BACKGROUND OF THE INVENTION

1. Field of the Invention

The present invention relates to the field of siphoning apparatus in general and in particular to a pressurized system used to decant the contents of expensive bottles of wine.

2. Description of Related Art

As can be seen by reference to the following U.S. Pat. Nos. 4,667,856; 5,114,033; 5,740,949; 5,376,272; 4,436,227, the prior art is replete with myriad and diverse pressurized fluid transfer systems for switching the fluid content of one fluid receptacle to another fluid receptacle.

While all of the aforementioned prior art constructions are more than adequate for the basic purpose and function for which they have been specifically designed, they are uniformly deficient with respect to their failure to provide a simple, efficient, and practical method and apparatus for decanting expensive wines into fresh bottles while retaining the sediment or lees in the original bottle.

As anyone who knows and appreciates expensive vintage wines is well aware, there is normally a 10%–15% loss of the fluid volume of the wine involved with current decanting methods and apparatus; and, while that percentage loss may not seem substantial to the uninitiated, it represents a significant financial loss and diminishment of the potential enjoyment that would have been derived from the lost volume of wine.

As a consequence of the foregoing situation, there has existed a longstanding need among connoisseurs of fine vintage wines for a new and improved wine decanting method and apparatus that removes almost the entire fluid volume of a bottle of fine vintage wine and only leaves 1%–2% of the original fluid volume along with the sediment or lees; and, the provision of such a method and apparatus is the stated objective of the present invention.

BRIEF SUMMARY OF THE INVENTION

Briefly stated, the method and apparatus that forms the basis of the present invention involves a pump unit, a fluid withdrawal unit and a support unit; wherein the pump unit and fluid withdrawal unit are operatively associated with one another and the interior of a bottle of wine and the support unit is operatively associated with the exterior of the bottle of wine to shift the widely distributed sediment or lees to a concentrated location away from the fluid withdrawal unit.

As will be explained in greater detail further on in the specification, the pump unit is provided to supply pressurized air to the interior of the bottle of wine to commence a siphoning action through the fluid withdrawal unit.

Of more importance, however, is the fact that the fluid withdrawal unit includes a fluid withdrawal head member provided with a one-way valve arrangement for limiting flow in one direction through the upper section of the head member, and a plurality of lateral passageways disposed at a specific height above the bottom of the lower section of the head member. The one-way valve member is provided to trap the last portion of wine that passes the valve member of subsequent gravity transfer into a decanting receptacle; and the height "h" of the lateral passageways is chosen to virtually eliminate the accidental passage of any of the consolidated lees in the bottom of the wine bottle through the lateral passageways in the head member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
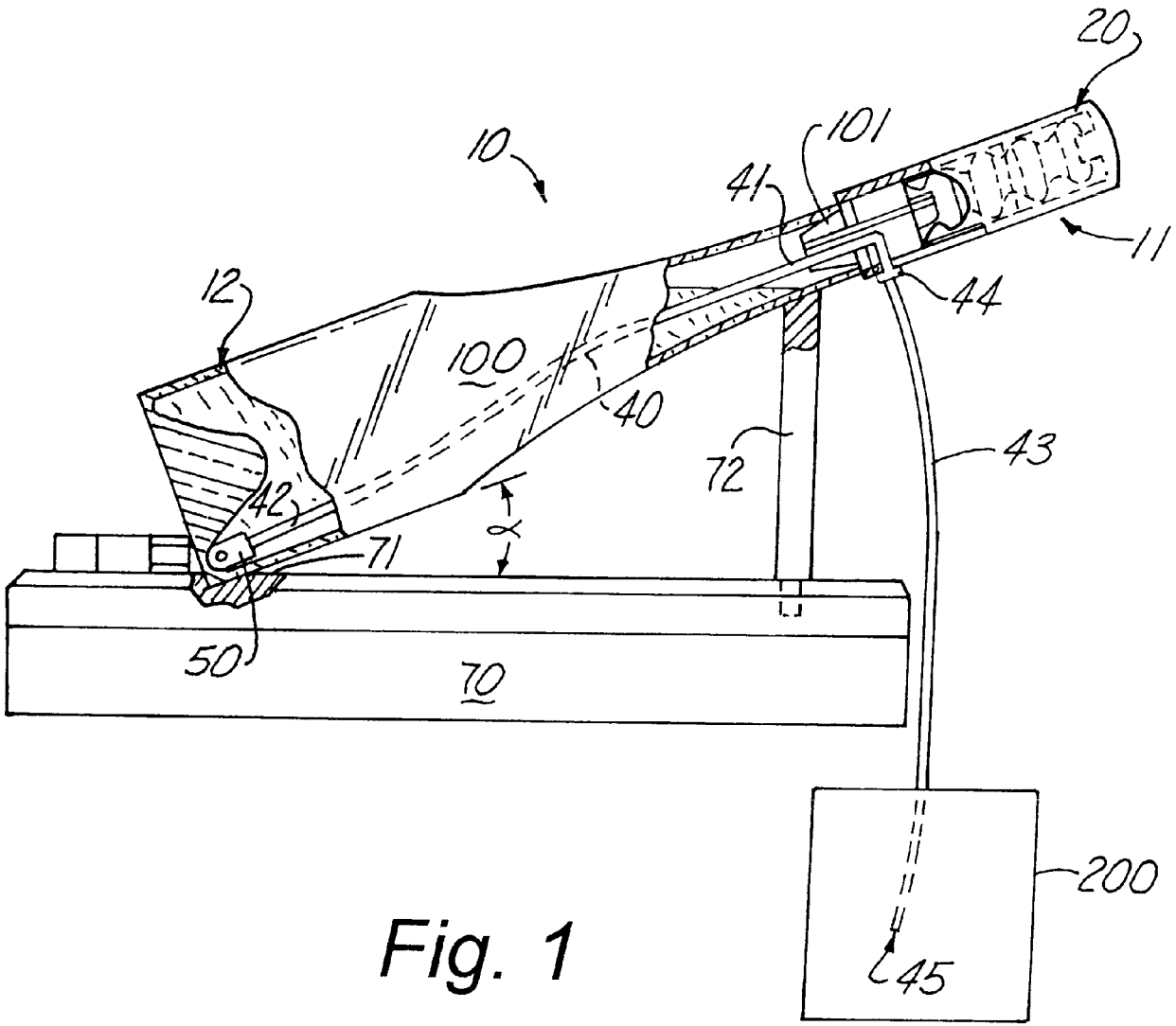
FIG. 1 is a perspective view of the wine decanting apparatus that forms the basis of the present invention being used to practice the method of the invention.

As can be seen by reference to the drawings, and in particular to FIG. 1, the wine decanting apparatus that forms the basis of the present invention is designated generally by the reference number 10. The apparatus (10) comprises in general a pump unit (11), a fluid withdrawal unit (12), and a support unit (13). These units will now be described in seriatim fashion.

Figure 2:
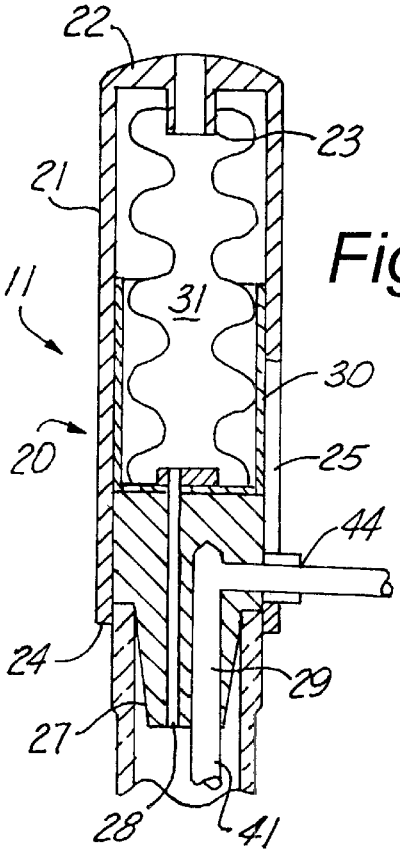
FIG. 2 is a cross-sectional view of the pump unit with the pump bellows fully inflated.
Figure 3:
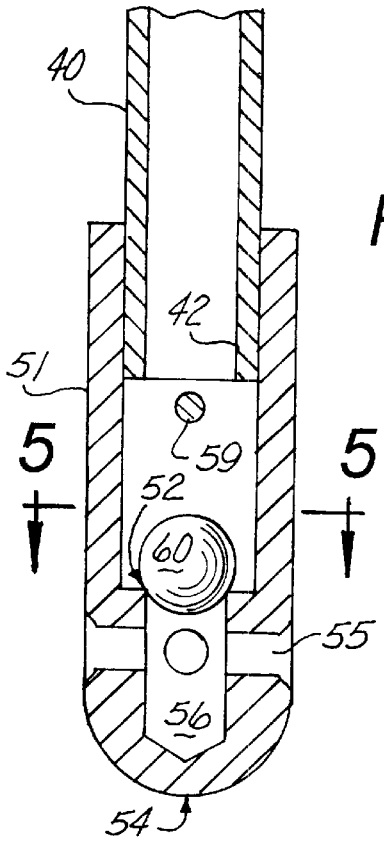
FIG. 3 is a cross-sectional view of the pump unit with the pump bellows fully compressed.

As shown in FIGS. 1 through 3, the pump unit (11) comprises in general a pump member (20) including an outer generally hollow cylindrical housing element (21) having a substantially closed upper end (22) provided with an inwardly directed short tubular segment (23); wherein the open lower end (24) of the outer housing element (21) is dimensioned to slidably receive the neck portion (101) of a bottle of wine (100) and is further provided with an elongated vertical slot (25) whose purpose and function will be described in greater detail.

In addition, the pump member (20) also includes a generally resilient inner stopper element (26) having a tapered lower end (27) adapted to seal the mouth of a bottle of wine; wherein, the stopper element (26) is further provided with a discrete vertical pressurization passageway (28) having an outlet end that is aligned with the vertical slot (25) in the outer housing element (21).

Still referring to FIGS. 1 through 3, it can be seen that the pump member (20) further includes a cup-shaped guide element (30) that is fixedly attached to the top of the resilient stopper element (26) and dimensioned to be slidably received in the interior of the housing element (21); and a bellows element (31) having an upper end in fluid communication with the tubular segment (23) of the outer housing element (21) and a lower end in open fluid communication with the pressurization passageway (28) in the inner stopper element (26).

Returning once more to FIG. 1, it can be seen that the fluid withdrawal unit (12) comprises a fluid inlet tube (40) having an upper end (41) operatively connected to the inlet end of the fluid outlet passageway (29) in the stopper element and a lower end (42) connected to a fluid withdrawal head member (50) which will be described in greater detail further on in the specification.

Furthermore, the fluid withdrawal unit (12) also includes an elongated fluid outlet tube (43) having one end (44) connected to the outlet end of the fluid outlet passageway (29) wherein the other end (45) is dimensioned to be received in a wine decanter (200) or other suitable receptacle positioned below the bottle to be decanted.

Figure 4:
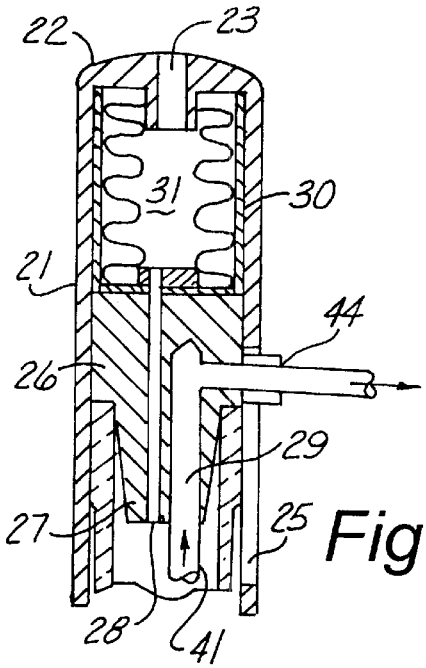
FIG. 4 is a partial cut away view of the fluid withdrawal head member.

As can best be seen by reference to FIGS. 4 and 5, the fluid withdrawal head member (50) has an upper reduced diameter hollow tubular section (51) provided with an internal stepped shoulder valve seat (52) dimensioned to receive a ball valve member (60) whose purpose and function will be described in greater detail further on in the specification. Furthermore a retaining pin 59 is provided to limit the movement of the ball valve member 60 within the reduced diameter hollow tubular section 51.

The fluid withdrawal head member (50) further includes an enlarged diameter generally cylindrical head section (53) having a rounded lower end (54) and a plurality of discrete horizontally disposed and radially aligned fluid inlet passageways (55) which are in open fluid communication with the vertically aligned central fluid passageway (56) in the fluid withdrawal head member (50); wherein, the transverse fluid passageways (55) are spaced a distance "h" from the rounded bottom (54) of the lower head section (53) for reasons that will be explained presently.

As can be seen by reference to FIG. 1, the support unit (13) includes an elevated base member (70) having an upper angled support surface (71) dimensioned to receive the bottom of a wine bottle (100), and an inverted L-shaped support arm (72) which is disposed proximate to, but spaced from, the angled support surface (71); wherein, the upper portion of the support arm (72) is adapted to engage the upper portion of the wine bottle (100) to maintain the bottom of the wine bottle at an angle of inclination "α" such that the sediments or lees will tend to collect at the lowest point within the (110) peripheral well of the wine bottle (100).

In the preferred embodiment of the invention, the value of the angle "α" will be approximately 15° to 25° and the value of the height "h" will be approximately ⅛" to ¼".

The method of employing the apparatus (10) will now be described in detail. First of all, the user will place a bottle (100) of vintage wine upon the angled support surface (71) of the base member (70) so that the lees will migrate toward the lowest point within the bottle (100). Then the user will insert the pump unit (11) and the fluid withdrawal unit (12) into the bottle (100) so that the fluid withdrawal head member (50) is disposed on the lowest side of the bottom of the bottle (100) and the stopper element (26) is sealingly engaged in the bottle neck (101).

At this point, the user would place the outlet end (45) of the fluid outlet tube (43) into a suitable decanting receptacle (200) placed at an elevation 12 to 18 inches below the bottle to be decanted and then cover the tubular segment opening in the upper end (22) of the housing element (21) with their thumb to seal off the upper end of the bellows chamber (31). Then by pressing down on the outer housing element (21), the bellows (31) will be collapsed to pressurize the air within the wine bottle which will force the wine at the bottom of the bottle (100) to flow into the lateral passageways (55) and up the central passageway (56) to unseat the ball valve member (60) and allow the wine to pass from the fluid inlet tube (40) through the fluid outlet tube (43) which deposits the wine in the receptacle (200).

This process continues until the fluid level of the wine falls below one of the lateral passageways in the lower head section (53) of the fluid withdrawal unit (12) from the bottle which would cause the wine downstream of the ball valve member (60) to drain back into the original wine bottle (100); wherein, that volume of wine upstream of the ball valve member (60) can be subsequently transferred to the new receptacle (200) by positioning the pump unit (11) and the fluid withdrawal unit (12) above the receptacle (200) and allowing the trapped volume of wine to flow by gravity into the receptacle (200).

Figure 5:
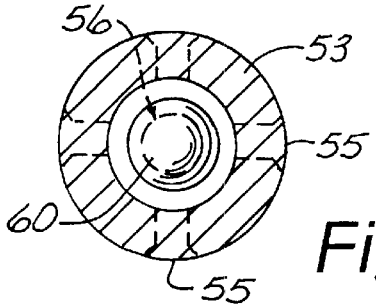
FIG. 5 is a cross-sectional view taken through line 5—5 of FIG. 4.

It should finally be noted that as suggested in FIGS. 5 and 6 of the drawings, lateral passageways (55) in the lower head section (53) are dimensioned such that the cross-sectional surface area of the central passageway (56) is approximately twice the combined cross-sectional surface area of the plurality of lateral passageways (55) to insure a minimum of turbulent flow of wine into the fluid withdrawal head member (50) to eliminate any unwarranted disturbance to the collected lees (110) within the wine bottle (100).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An apparatus for transferring the fluid contents of a wine bottle to a decanting receptacle wherein the accumulated lees remain within the wine bottle wherein the apparatus comprises:

a pump unit including a pump member operatively and sealingly connected to the mouth of a wine bottle wherein the pump member is provided with means for introducing pressurized air into the interior of the bottle; and, a fluid withdrawal unit including: a fluid inlet tube having a lower end provided with a fluid withdrawal head member having a central passageway in open fluid communication with said fluid tube and a plurality of lateral passageways are in open fluid communication with the interior of the wine bottle and spaced a height of "h" from a closed bottom of the fluid withdrawal head member; and, a fluid outlet tube in open communication with said fluid inlet tube; wherein the value of the height "h" is approximately ⅛" to ¼"; wherein the cross-sectional surface area of the central passageway is greater than the combined cross-sectional surface areas of the plurality of lateral passageways; wherein, said fluid withdrawal head member has an upper tubular section provided with a stepped shoulder valve seat adapted to receive a ball valve member; and a support unit including a base member having an angled support surface for receiving the bottom of a bottle of wine and a support arm element disposed proximate to, but spaced from, said angle support surface and adapted to engaged the upper portion of a wine bottle at an angular inclination "α" wherein the value of "α" is approximately 15° to 25°.

2. The apparatus as in claim 1; wherein, the cross-sectional surface area of the central passageway is approximately twice as great as the combined cross-sectional surface areas of the plurality of lateral passageways.

3. A method of decanting an uncorked bottle of wine into a decanting receptacle employing the steps of:

a) introducing a fluid inlet tube into the bottle of wine wherein the fluid inlet tube has an upper end in fluid communication with a fluid withdrawal head member having a closed bottom, and a central passageway connected to a plurality of lateral passageways which are apaced from the bottom of the fluid withdrawal head member by by a height "h " having a value of approximately ⅛" to ¼";

b) engaging the bottom of the fluid withdrawal head member with a portion of the bottom of the interior of the bottle;

c) placing the outlet end of the fluid outlet tube in said decanting receptacle;

d) sealing open mouth of the wine bottle;

e) supporting the bottom of the bottle of wine at an angle of inclination "α" where the value of "α" is approximately 15° to 25°;

f) introducing pressurized air through the sealed mouth of the wine bottle to force wine though the fluid withdrawal head member ,the fluid inlet tube, the fluid outlet tube and into the decanting receptacle; and g) providing the upper portion of the fluid withdrawal head member with valve means for limiting the direction of fluid flow though the upper potion of the fluid withdrawal head member.

4. The method as in claim 3; further including the subsequent step of positioning the bottom end of the fluid withdrawal head member proximate to the raised end of the interior of the bottom of the wine bottle.

* * * * *